US006715696B2

(12) United States Patent
Pierce

(10) Patent No.: US 6,715,696 B2
(45) Date of Patent: Apr. 6, 2004

(54) REMOTE CONTROL BIN DEVICE

(76) Inventor: Kevin J. Pierce, 6473 E. Lake Dr., Grand Forks, ND (US) 58201

( * ) Notice: Subject to any disclaimer, the term of this patent is extended or adjusted under 35 U.S.C. 154(b) by 206 days.

(21) Appl. No.: 09/921,951

(22) Filed: Aug. 3, 2001

(65) Prior Publication Data

US 2003/0024998 A1 Feb. 6, 2003

(51) Int. Cl.[7] ..... E01H 3/02; A01C 17/00

(52) U.S. Cl. ..... 239/172; 239/650; 239/661; 239/665; 239/668; 239/670; 239/672; 239/675; 239/679; 239/681; 239/682; 239/684

(58) Field of Search ..... 239/650, 661, 239/663, 664, 665, 667, 668, 670, 671, 672, 673, 675, 677, 679, 680, 681, 682, 683, 684, 172

(56) References Cited

U.S. PATENT DOCUMENTS 4,212,428 A * 7/1980 Walker ..... 239/677
6,149,079 A * 11/2000 Kinkead et al. ..... 239/668
6,220,531 B1 * 4/2001 Pierce et al. ..... 239/672
6,508,419 B1 * 1/2003 Kinkead et al. ..... 239/668
6,533,198 B1 * 3/2003 Podevels et al. ..... 239/676

* cited by examiner

*Primary Examiner*—Robin O. Evans
(74) *Attorney, Agent, or Firm*—Robert E. Kleve

(57) ABSTRACT

The invention comprises a towable trailer having a first frame and a bin, conveyor, and spinners mounted on a second frame. The bin carries materials which are conveyed by the conveyor to the spinners at the rear of the bin which spin and spread the material on the ground as the trailer is towed along the ground. The trailer is towed by a powered vehicle. A remote control device has an electrical connection to the mechanism on the trailer for operating the conveyor and spinners. The remote control device can be mounted on the trailer and operated or by cable from equipment or mechanism on the trailer to the remote control device, the remote control device may be operated on the control panel of the powered vehicle.

3 Claims, 1 Drawing Sheet

REMOTE CONTROL BIN DEVICE

BACKGROUND OF THE INVENTION

This invention related to bins on mobile vehicles for conveying and spreading materials.

It is an object of the invention to provide a novel towable trailer which has a bin for carrying materials to a location and a conveyor and a pair of spinners or spreaders with conveyor conveying material in the bin to the spinners and with the spinners receiving and spreading the material on the ground. A remote control device has a electrical connection to motors for powering the conveyor and spinner and from varying the speed of the motors to vary the speed of the conveyors and spinners. The remote control device can be mounted on the trailer and operated or it can be mounted on a power vehicle towing the trailer and the speed of the motors and be controlled from the powered vehicle.

It is another object of the invention to provide a novel apparatus for mounting on a vehicle which apparatus has a bin, and conveyor and a spinner and powering means for powering the conveyor and spinner including means to varying the speed of powering means.

It is another object of the invention to provide a novel trailer which has a bin, conveyor, and a spinner and has motors for powering the speed of the conveyor and spinner. A remote control apparatus is provided for remotely controlling and varying the speed of the conveyor and spinners from a remote location.

BRIEF DESCRIPTION OF THE DRAWINGS

Further objects and advantages of the invention will become apparent as the description proceeds and when taken in conjunction with the accompanying drawings wherein.

BACKGROUND OF PREFERRED EMBODIMENT

Figures 1, 2, 3, 4:
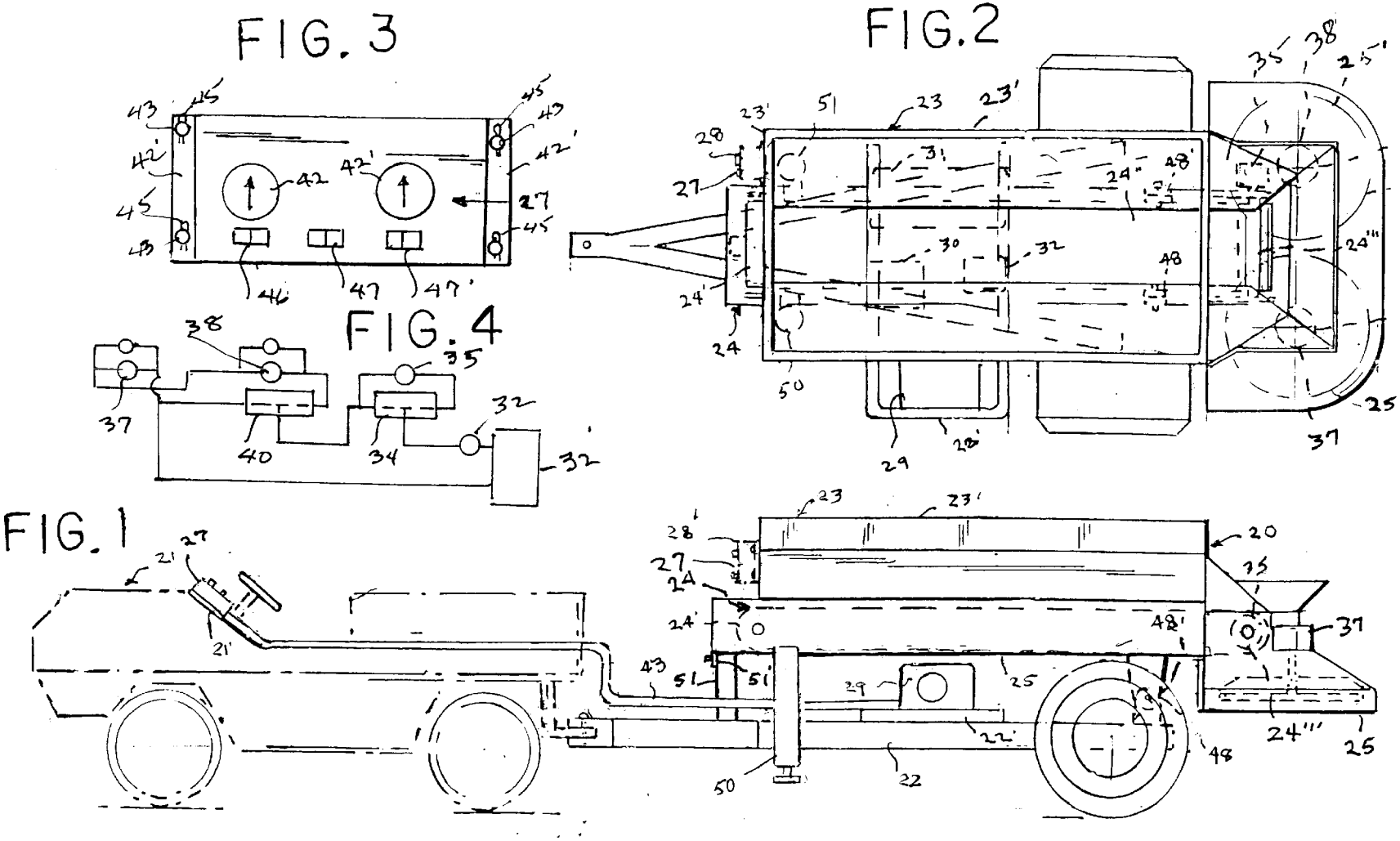
FIG. 1 is a side elevational view of the trailer invention illustrating a trailer having a bin and a conveyor and a pair of spinners with motors powering the conveyor and powering the spinners. The trailer is attached to a powered vehicle for being towed by the powered vehicle and showing a remote control mounted on the powered vehicle with a flexible electrical cable connecting the remote control to controls on the trailer controlling the speed of the motors powering the conveyor and spinners.
FIG. 2 is a top elevational view of the trailer invention.
FIG. 3 is an enlarged front view of the control box.
FIG. 4 is a schematic circuit diagram of the electrical and hydraulic circuit of the trailer invention.

Referring more particularly to the drawings, in FIG. 1, the trailer invention 20 is illustrated shown attached to a tractor or power vehicle 21 for being towed by the powered vehicle. The trailer 20 has a main frame 22. A bin apparatus 23 has a bin 23, a conveyor 24 mounted beneath the bin. The bin and conveyor are mounted on a separate frame 25, separate from the mobile frame. A pair of spreading spinners 26 and 26' are mounted to the rear of the bin beneath the rear end of the conveyor, so as to also be mounted on the separate frame 25. A remote control box 27 for controlling the conveyor and spinner has a mounting frame for detachably mounting the control box to either the dashboard 21' of the powered vehicle 21 or to the front wall 23' of the bin 23 as shown in phantom lines 28 and FIGS. 1 and 2. The control box 27 has switches and rheostats to control and vary the speed of the conveyor and spinners. A gasoline motor 29 is mounted to a cross frame 22' of the main frame 22 of the apparatus. A battery 30 is also mounted on the cross frame 22' to provide electricity for powering the spark of a gasoline motor 29. A gasoline tank 31 is also mounted on the cross frame of the main frame of bin apparatus. The gasoline motor powers a hydraulic pump 32 from a reservoir 32', which are also mounted on the main frame 22. The pump provides hydraulic fluid under pressure to the hydraulic motor 35 via a solenoid actuated control valve 34. The hydraulic motor 35 is mounted coaxially to the rear roller 24' of the conveyor 24 for rotating the rear roller and thereby rotating the conveyor belt 24" mounted about the rear and front and rear rollers, 24' and 24", respectively. The solenoid control valve 34 is powered by the battery and solenoid actuated to start and stop and the rotary control rheostat 42 varies the current to the proportionate solenoid to vary the speed or rate of fluid flowing from the reservoir on the main frame to the hydraulic motor 35 and thereby vary the control and vary the speed of the conveyor motor 35.

The pair of spinners 25 and 25' are mounted to the rear of the trailer beneath the rear end of the conveyor 24. The spinners each have a disc which a shaft fixed centrally to the disc at one end and fixed coaxially to the output shaft of hydraulic motors 37 and 38, so that actuation of the motor rotates the spinners. The pump 32 also provides fluid under pressure to the hydraulic motors 37 and 38 via a solenoid actuated control valve 40. A solenoid actuated control valves 34 and 40 are also powered by the battery and is mounted in the hydraulic line from the pump and is controlled by the variable rheostat 42' to vary the amount of fluid pumped to the motors 37 and 38 and thereby vary the speed of the motors to thereby vary the speed of rotation of the discs, as well as to turn the motors 37 and 38 on and off.

The remote control box 27 is detachably mounted to either the dashboard 42 of the tractor 21 or to the front wall 23' of the storage bin 23 of the trailer. Pins 43 are fixed to the dashboard of the towing vehicle 21 and to the front wall of the bin 23 which are received in bores in the flanges 42' of the box and cotter keys 45 are inserted in bores in the pins to hold the flanges 42' of the box either on the dashboard for front ball of the bin.

The remote control box 27 has the two rheostat controlled rotary switches 42 and 42' which may be rotated to vary the electrical signal to the solenoid actuated valves 34 and 40 to thereby vary the positioning of the solenoid which in turn acts to vary the position of their hydraulic valves and thereby vary the speed of the conveyor motor and spinner motors, respectively. The control box also has a master switch 46 and on and off switches 47 and 47' for the conveyor and spinners, respectively.

The rheostat switches 42 and 42' on the box vary the current to proportional solenoids on each valve to regulate the amount of oil going to each motor for the spinners and the motor for the conveyor to thereby regulate the speed of the spinners and the speed of the conveyor.

A flexible cable connection 43 electrically connects the rheostat switches on the control box with the solenoid actuated control valve 34 on the trailer for the conveyor motor and to the solenoid actuated control valve 40 on the trailer for the spinner motors 37 and 38. The cable connection has sufficient length so that the control box may be mounted on the tractor dash board.

This enables the operator, while seated on the tractor and operating the tractor to tow the trailer for spreading material on the ground by the spinners from the bin or box 23, to control and vary the speeds of the conveyor and spinners individually and remotely from the tractor without having to get off the tractor at any time and go to the trailer to change the setting of the switches for varying the speed of the conveyor and spinner motors or for turning the motors on and off.

While the invention illustrates an electrical cable connection between the control box while on the tractor and the control valves on the trailer to change the settings of the speeds of the conveyor and spinners, it is contemplated that a radio controlled wireless connection between the remote control switches on the control box, and the control valves on the trailer may be provided to eliminate a physical cable connection while nevertheless providing the remote control from the tractor for the operation.

The conveyor frame is pivotally mounted to the mobile frame at a pair pivotal connections 48 and 48' to enable to the conveyor frame, including the bin 23, conveyor 24, and spinners 25 and 25' to be pivoted upward about the pivots 48 and 48' relative to the mobile frame 22 to an angular position. A post 51 is fixed to the main frame 22. A flange 51' is fixed to the conveyor 23 and projects downward and a pin is inserted through the flange into a bore in the post to lock the bin from pivoting upward about the pivots 48 and 48'. The pivoting the conveyor apparatus including the bin, conveyor and spinners upward to their angular position enables a person to do maintenance and repair work upon the gasoline motor, and other electrical and hydraulic elements mounted on the mobile frame beneath the conveyor frame.

It will be obvious that various changes and departures may be made to the invention without departing from the spirit and scope thereof, and accordingly, it is not intended that the invention be limited to that specifically described in the specification, or as illustrated in the drawings but only as set forth in the appended claims wherein:

What is claimed is:

1. A towable trailer for towing by a tractor having a operator's compartment; said trailer having material spreading and conveying means including a storage bin with a conveyor beneath the bin and a spinner at the rear of the bin; a hydraulic motor powering the conveyor and a hydraulic motor powering the rotation of the spinner, a pair of solenoid actuated control means on said trailer; a remote electric control box having a pair of variable electric rheostats on said box; a flexible electric cable flexibly and electrically connecting the pair of electric variable rheostats on the box to the pair of solenoid actuated control means on the trailer to operate the solenoids; one of said variable electric rheostats actuating, through said cable, one of said solenoid actuated control means acting to vary the speed of the hydraulic motor means on the trailer to vary the speed of the hydraulic motor to power the conveyor; the other of said variable electric rheostats actuating, through said cable, the other of said solenoid actuated control means acting to vary the speed of the hydraulic motor to the rotate the spinner.

2. A towable trailer having a bin with a conveyor mounted beneath the bin and spinner means mounted to the rear of the conveyor, said trailer having a remote electric control box, a hydraulic motor on said trailer to power the conveyor and hydraulic motor means to power the spinner means of said trailer, electric solenoid means on said trailer to vary the speed of said hydraulic motor means of said conveyor and electric solenoid means on the trailer to vary the speed of the hydraulic motor means to power the spinner means, said electric control box having a variable electric rheostat for the conveyor motor and a variable electric rheostat for the spinner motor, flexible electric cable connecting the electric variable rheostats on the box to the solenoid actuated control means on the trailer for the conveyor and the solenoid actuated control means for the spinner to control the solenoids with the solenoids acting to individually vary the speed of the hydraulic motor means on the trailer to individually vary the speed of the conveyor and spinner means, respectively, on the trailer in response to the variable rheostats.

3. A towable trailer according to claim 2 wherein the control box is detachably mounted to the railer and detachably mounted to a vehicle towing the trailer with the cable being of sufficient length to reach the vehicle towing the trailer.

* * * * *